United States Patent [19]

Spalding

[11] Patent Number: 4,583,304

[45] Date of Patent: Apr. 22, 1986

[54] BALLET SLIPPER

[76] Inventor: Murray Spalding, 1552 33rd St., NW., Washington, D.C. 20007

[21] Appl. No.: 787,703

[22] Filed: Oct. 15, 1985

Related U.S. Application Data

[63] Continuation of Ser. No. 604,932, Apr. 27, 1984, abandoned.

[51] Int. Cl.[4] ..... A43B 5/12

[52] U.S. Cl. ..... 36/113; 36/8.3; 36/34 R

[58] Field of Search ..... 36/102, 113, 8.3, 34 R, 36/10, 9 R

[56] References Cited

U.S. PATENT DOCUMENTS

| | | | |
|---|---|---|---|
| 1,553,196 | 9/1925 | Solomonoff | 36/113 X |
| 1,611,951 | 12/1926 | Robertson | 36/102 |
| 2,455,459 | 12/1948 | Witlin | 36/102 X |
| 2,641,004 | 6/1953 | Whiting et al. | 36/9 R X |
| 2,724,194 | 11/1955 | Gustin | 36/102 |

FOREIGN PATENT DOCUMENTS

| | | | |
|---|---|---|---|
| 70322 | 6/1946 | Norway | 36/9 R |

*Primary Examiner*—Werner H. Schroeder
*Assistant Examiner*—T. Graveline
*Attorney, Agent, or Firm*—Scrivener Clarke Scrivener and Johnson

[57] ABSTRACT

A ballet slipper has a wedge shaped heel the front end of which is beneath the metatarsal arch and the rear surface of which is just behind the heel bone.

1 Claim, 2 Drawing Figures

BALLET SLIPPER

This application is a continuation, of application Ser. No. 604,932, filed Apr. 27, 1984 now abandoned.

SUMMARY OF THE INVENTION

A ballet slipper has a flat stiff sole which is flat forward of the metatarsal arch of the foot of the wearer and which extends angularly upwardly rearward of the arch where it covers the upper surface of a generally wedge shaped heel, the vertical rear surface of which underlies the heel of the wearer's foot.

DESCRIPTION OF THE PREFERRED EMBODIMENT OF THE INVENTION

Figure 1:
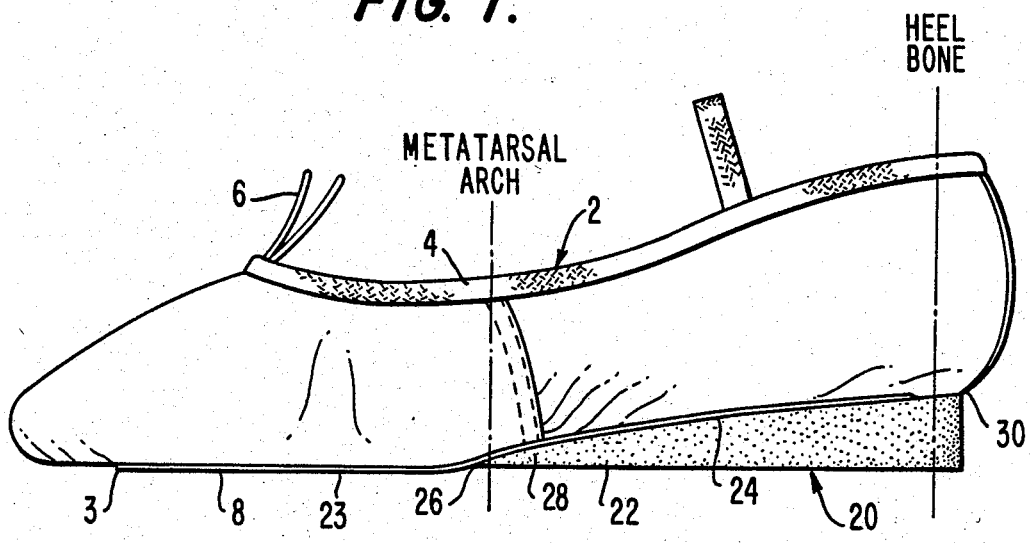
FIGS. 1 and 2 are, respectively, side elevational and bottom views of the ballet slipper provided by the invention.
Figure 2:
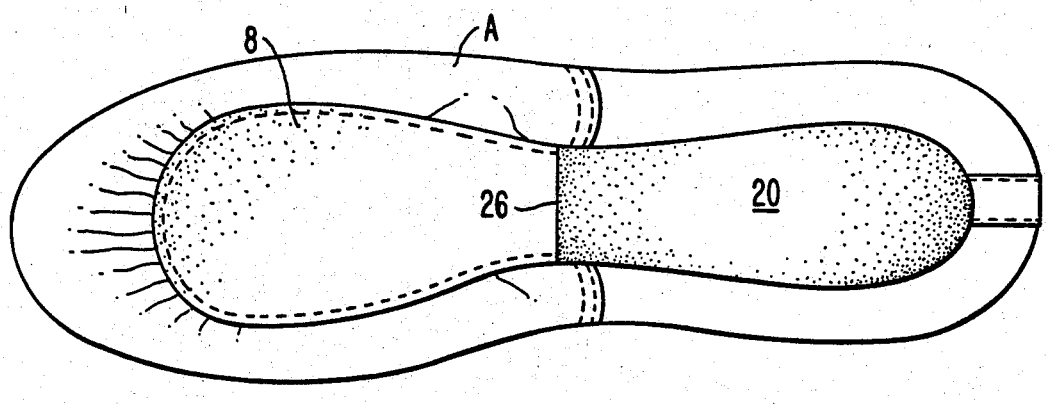

The preferred embodiment of the ballet slipper provided by the invention is disclosed in the drawings and comprises a foot encasing body A which is made of leather, satin or any other suitable material properly shaped and provided along the top edge of the foot-inserting opening 2 with a continuous binding 4 in which may be mounted a drawstring 6 adapted to be pulled and tied at the front of the slipper to cause the slipper to be held firmly upon the foot. The slipper is lined with any suitable material, and the lower edge portions of the foot encasing body A, including the lining are gathered between an insole(not shown) and the outersole 8, which constitute the shank of the slipper and are formed of stiff leather to allow the wearer to dance flat as well as on demi-pointe. The insole and outersole and the material between them are held together by glue so that after being shaped and connected the proper contour will be maintained. The part of the outer sole forward of the metatarsal arch of the foot is flat, as shown in FIG. 1, and the part B rearward of the metatarsal arch is inclined upwardly and rearwardly of the slipper to follow the configuration of the upper surface of the heel of the slipper, which will be described.

Means are provided by the invention for reducing the stress and dangers imposed on the dancer's body by the rigors of ballet dancing, as well as dancing upon hard surfaces, and these means comprise the configuration of the sole and a wedge shaped heel 20 which, in the preferred embodiment, is attached to the rearward part of the outer sole of the slipper.

The heel 20 has a flat lower surface 22, which forms a rearward extension of the flat forward part 3 of the outer sole 8, and an upper surface 24 which joins the lower surface 22 in a straight line apex 26 extending transversely of the lower surface of the heel of the slipper. The upper surface extends rearwardly from apex 26 at an angle of approximately 10°, and the front part of the upper surface is slightly upwardly curved for a short distance as shown at 28, and then ascends as a flat surface at the approximate angle of 10° to the horizontal lower surface of the heel as shown at 20.

In order to achieve the best results, in both dancing performance and reduction of stress and bodily discomfort, the front end of the heel is located beneath the metatarsal arch and the rear end beneath the heel bone of the foot, both as indicated in the drawings. In a 4C Capezio slipper the heel is approximately $3\frac{3}{4}$ inches long, $1\frac{3}{8}$ inches wide at the forward end 26, and $1\frac{7}{8}$ inches wide at its rear end, and these proportions are the same for slippers of other sizes. The heel is made of a rigid material, preferably 36 iron foam crepe, and may be glued in place on the outer sole 8.

The basic ballet slipper which is modified by the invention therefore comprises an outer sole which extends longitudinally of the slipper and is narrower than the foot encasing part of the slipper. This outer sole extends from a forwardly and outwardly curved front end which is positioned rearwardly of the toes to a rear end which is positioned approximately below the heel of the wearer. The edge of the flexible material of the foot encasing part of the slipper is held between the inner and outer soles and are gathered at the front end of the outer sole.

It has been found that use of a ballet slipper, formed in accordance with this invention, has many beneficial effects on the dancer's body. The wedge heel tilts the body by causing the talus to plantar flex, which in turn increases the stability of the ankle which, in turn, allows the hip to control the rotation of the leg. This latter effect is due to the fact that when the foot is in plantar flexion it is controlled more easily by the hip, thus helping the dancer to achieve maximum "turn out," another vital element in the technique of a ballerina. In addition, the wedge acts as a springboard, thus allowing the dancer to perform elevational movements more easily.

In addition, the wedge with the composite configuration of its upper surface produces beneficial positive effects and reduces negative effects resulting from ballet dancing. Specifically, use of the wedged slipper cushions the foot, and reduces the jarring effect of jumping, thus preventing build-up of bone spurs in the ankle, knee and hip joints. Also, its use relieves excess strain on the Achilles tendon attachment or the posterior calanus, thus preventing Achilles tear and tendonitis, and alleviating strain of the gastronemus, plantaris and solaris.

I am well aware that wedge heels have been used on shoes, sandals and the like, but my invention is not to be confused with these as it is solely related to ballet slippers having the specific wedge heel configuration described in the appended claims.

I claim:

1. A ballet slipper comprising:

(a). a foot encasing part formed of at least one layer of material, and inner and outer soles having a stiffness allowing a dancer to dance flat or demi-pointe, and between which edges of the material are gathered, the part of the outer sole forward of the metatarsal arch of the foot of the wearer being flat and the part rearward of the arch being upwardly inclined, and (b). a heel connected to the rearward part of the outer sole and having:

(i). a front end edge extending transversely of the slipper and positioned beneath the part of the slipper underlying the metatarsal arch of the foot, (ii). a flat lower surface which extends rearwardly from the front end edge of the heel and lies in the plane of that part of the outer sole which is forward of the metatarsal arch, (iii). an upper surface which is connected to the lower surface of the part of the outer sole which is rearward of the metatarsal arch of the foot and extends upwardly from the front end edge of the heel and is upwardly convexly curved from the front end edge of the heel for approximately one-third the length of the heel and the remaining part of which is flat and upwardly inclined at an angle of approximately 10°, and (iv). a vertical rear surface which extends transversely of the heel of the slipper and connects the lower and upper surfaces of the heel and which is positioned beneath the part of the slipper which underlies the heel bone of the foot of the wearer.

* * * * *